US005803287A

United States Patent [19]

Kusz

[11] Patent Number: 5,803,287

[45] Date of Patent: Sep. 8, 1998

[54] CONSUMER FRIENDLY PACKAGE

[75] Inventor: Maximillian Kusz, Waterville, Ohio

[73] Assignee: Owens-Illinois Closure Inc., Toledo, Ohio

[21] Appl. No.: 844,869

[22] Filed: Apr. 22, 1997

[51] Int. Cl.[6] ..... B65D 41/04

[52] U.S. Cl. ..... 215/330; 215/331; 215/44

[58] Field of Search ..... 215/216, 330, 215/331, 44

[56] References Cited

U.S. PATENT DOCUMENTS

| | | | |
|---|---|---|---|
| D. 166,526 | 4/1952 | Buckingham . | |
| D. 277,736 | 2/1985 | Long . | |
| D. 358,769 | 5/1995 | Luch et al. . | |
| 2,153,426 | 4/1939 | McNamara et al. . | |
| 3,405,827 | 10/1968 | Garden . | |
| 3,422,978 | 1/1969 | Quackenbush . | |
| 3,435,978 | 4/1969 | Wittwer . | |
| 3,682,343 | 8/1972 | Landen . | |
| 3,741,421 | 6/1973 | Wittwer . | |
| 3,797,688 | 3/1974 | Porcelli et al. . | |
| 3,905,509 | 9/1975 | Markowitz . | |
| 3,968,894 | 7/1976 | Hermann . | |
| 4,084,717 | 4/1978 | King . | |
| 4,093,096 | 6/1978 | Augros . | |
| 4,278,180 | 7/1981 | Willis . | |
| 4,280,631 | 7/1981 | Lohrman . | |
| 4,289,248 | 9/1981 | Lynn . | |
| 4,387,822 | 6/1983 | Lynn . | |
| 4,526,289 | 7/1985 | Schiemann . | |
| 4,591,063 | 5/1986 | Geiger | 215/330 |
| 4,646,949 | 3/1987 | Stull | 222/521 |
| 4,913,299 | 4/1990 | Petro . | |
| 4,934,547 | 6/1990 | Mayes et al. . | |
| 5,092,477 | 3/1992 | Johnson, Jr. et al. . | |
| 5,115,929 | 5/1992 | Buono . | |
| 5,143,237 | 9/1992 | Lindsey et al. . | |
| 5,197,616 | 3/1993 | Buono . | |
| 5,213,225 | 5/1993 | King et al. . | |
| 5,381,912 | 1/1995 | Walker et al. . | |
| 5,411,157 | 5/1995 | King et al. | 215/330 |
| 5,533,633 | 7/1996 | King | 215/252 |

*Primary Examiner*—Stephen Cronin

[57] ABSTRACT

A consumer friendly package including a plastic closure having multiple threads which engage multiple threads on the finish of a plastic container. The closure has at least one and preferably four radially inwardly extending lugs that engage a radial abutment on the finish of the container to provide an audible click when the closure is fully applied. The finish of the container is provided with at least one, preferably two axial projections that extend downwardly from the threads on the finish and are engaged by the threads on the closure to retard back-off of the closure and eliminate the effects upon sealing of stack up between the tolerances of manufacture of the finish, closure and liner in the closure.

18 Claims, 2 Drawing Sheets

CONSUMER FRIENDLY PACKAGE

This invention relates to packages for solid pharmaceutical products and the like and particularly to such packages which utilize plastic closures and containers.

BACKGROUND AND SUMMARY OF THE INVENTION

In the packaging of solid pharmaceutical products and the like, it is desirable to provide a package which effectively seals and protects the product and at the same time may be readily opened and closed by adults.

A typical package with a screw cap closure is applied to a container by rotating the closure in a clock-wise direction onto the finish of the container. Further rotation of the closure tightens the closure on the finish. Generally, the tighter the closure is applied to the finish, the greater the removal torque that must be applied to the closure to loosen it from the finish. There is a time element involved, whereby, the greater the elapsed time from closing the package, until it is again opened there is some degradation in the removal torque in an asymptotic manner which may result in back off of the closure. This degradation of torque is affected by a number of other variables, one of which is the pitch of the threads. Generally, the steeper the pitch of the threads, the greater the magnitude of the degradation. Therefore, a paradox exists; the packages should be quickly and easily opened but these same packages must protect the contents by having a closure system which keeps the closure securely fastened on the container finish.

One such package is shown in King et al U.S. Pat. No. 5,213,225. In this patent a rib on the interior of the closure is locked between a pair of abutments on the container finish, when the closure is fully applied. Sealing of this package is accomplished by a sealing ring that contacts the top inside of the container finish. To make this seal commercially acceptable one needs to insure that the seal ring has adequate engagement with the interior of the container finish over the height tolerances of the closure and container.

If the packaging engineer decides that a liner is required to provide a tamper evident seal over the mouth of the container such as that provided by aluminum foil induction seals, the package shown could not be used because the seal ring in the closure is not compatible with these seals. Further if one were to remove the seal ring from the closure and merely insert one of these tamper evident seal type liners into the closure, the closure and container height tolerances would now affect the sealing of the package. That is, the package may or may not be sealed when the rib is locked between the pair of abutments on the container finish. Whether a tamper evident seal is preferred or not, the problem of closure and container height tolerances exists with this design, with regard to package sealing with disk type liners.

Among the objectives of the present invention are to provide a consumer friendly package which permits the user to recognize that the closure has been applied fully to protect the contents; which provides a seal over a range of finish tolerances; which eliminates inadvertent back-off of the closure; which provides an audible click upon application of the closure; wherein the closure is maintained centered to the container finish; and which provides easy access to the contents.

In accordance with the invention, the consumer friendly package embodying the invention comprises a plastic closure having multiple threads which engage multiple threads on the finish of a plastic container. The closure has four radially inwardly extending lugs that engage a radial abutment on the finish of the container to provide an audible click when the closure is fully applied. The finish of the container is provided with two axial projections that extend downwardly from the threads on the finish and are engaged by the threads on the closure to retard back-off of the closure and eliminate the effects upon sealing of stack up between the tolerances of manufacture of the finish, closure and liner in the closure.

DESCRIPTION OF THE PREFERRED EMBODIMENTS

Figure 1:
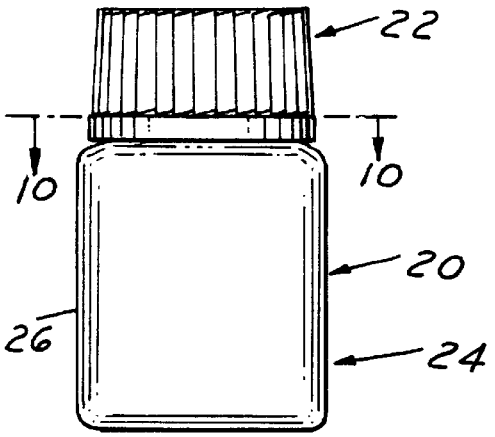
FIG. 1 is an elevational view of a consumer friendly package embodying the invention.
Figure 2:
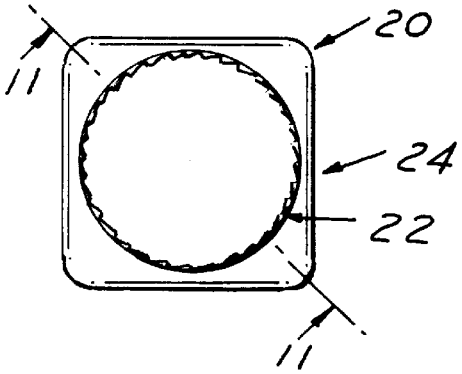
FIG. 2 is a top plan view.

Referring to FIGS. 1 and 2, the consumer friendly package 20 embodying the invention comprises a plastic closure 22 and a plastic container 24, herein shown as being square in cross section. The closure 22 and container 24 are made of plastic material preferably polypropylene.

Figure 3:
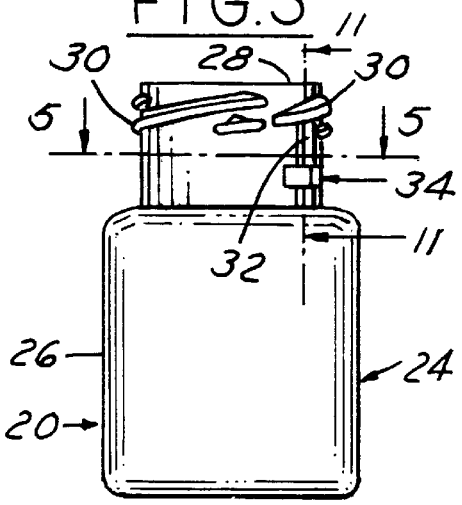
FIG. 3 is an elevational view of the container which forms part of the package.
Figure 4:
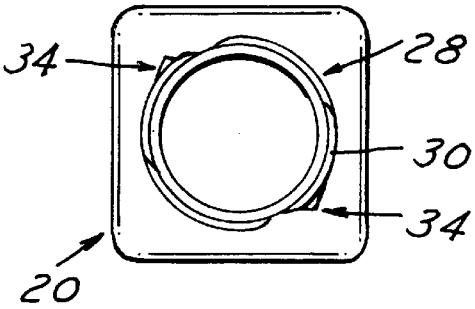
FIG. 4 is a top plan view of the plastic container.
Figure 5:
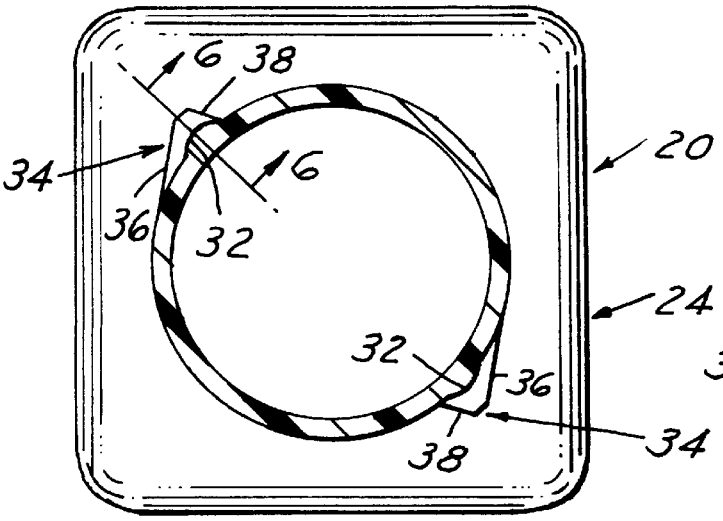
FIG. 5 is a sectional view on an enlarged scale taken along the line 5—5 in FIG. 3.
Figure 6:
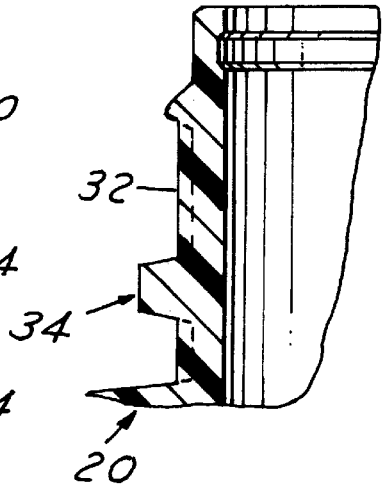
FIG. 6 is a fragmentary sectional view taken along the line 6—6 in FIG. 5.

As shown in FIGS. 3–5, the plastic container 24 includes a body 26 and a finish 28 having thread means herein shown as a plurality of external threads 30, herein shown as four in number. In addition, the finish 28 includes at least one axial projection 32 extending axially downwardly toward the body 26. At least one but preferably two circumferentially spaced abutments 34 extend from the finish 28 below the threads 30, at 180 degrees to one another. Each projection 34 includes an inclined surface 36 extending outwardly in the direction of the threads 30 and a stop surface 38 extending radially outwardly of the finish 28 at a lesser angle to a radial plane through the axis of the container.

Figure 7:
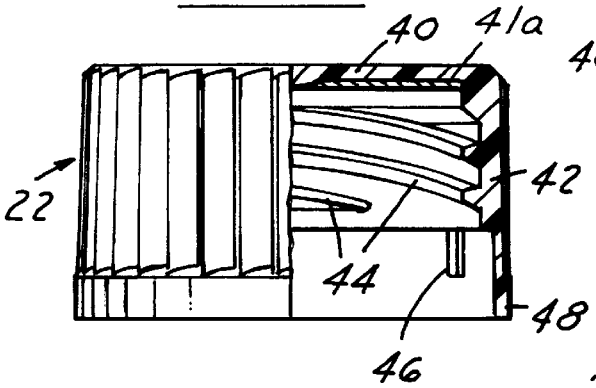
FIG. 7 is a part sectional elevation view on an enlarged scale of the plastic closure utilized in the package.
Figure 8:
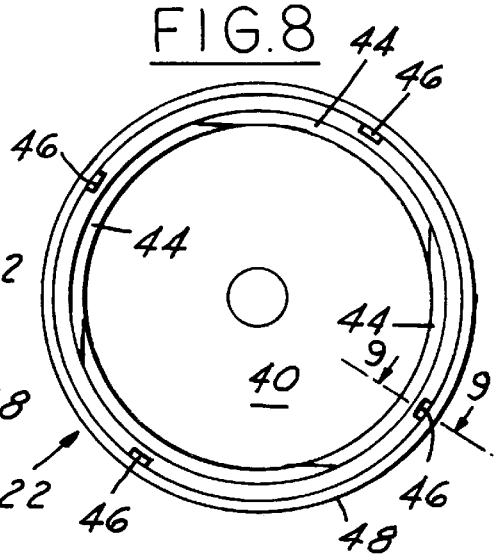
FIG. 8 is a bottom plan view of the closure.
Figure 9:
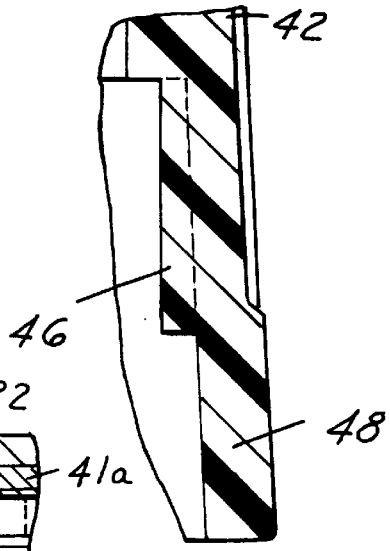
FIG. 9 is a sectional view on an enlarged scale taken along the line 9—9 in FIG. 8.
Figure 11:
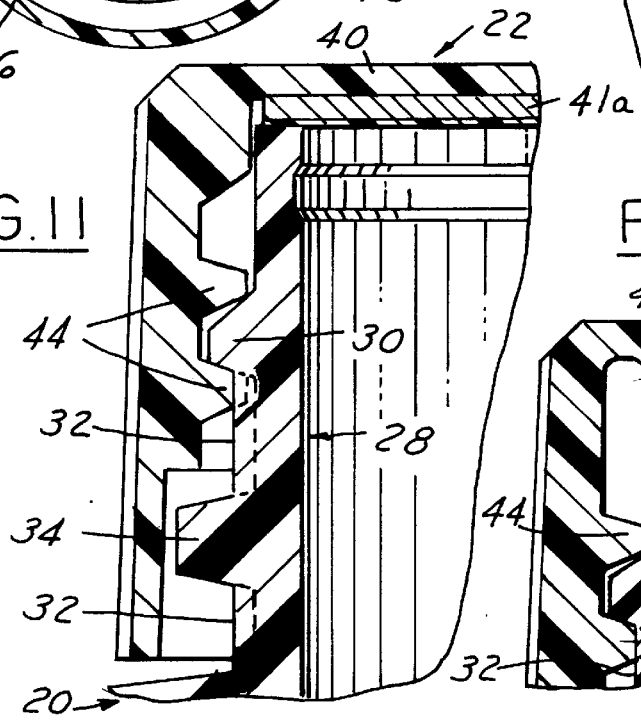
FIG. 11 is a sectional view taken along the line 11—11 in FIG. 2.
Figure 12:
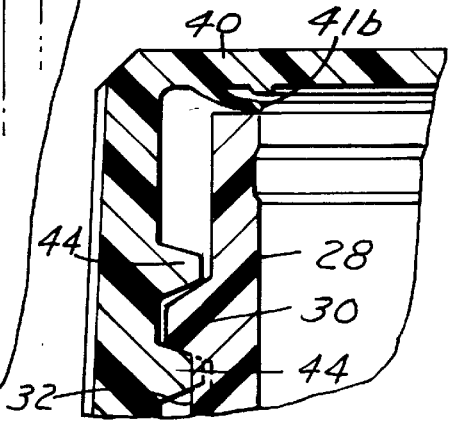
FIG. 12 is a fragmentary sectional view similar to FIG. 11 of a modified form of package.

Referring to FIGS. 7–9, the closure 22 includes a base wall 40 and a peripheral skirt 42 extending from the base wall 40. Resilient sealing means is provided on the inner surface of base wall 40, herein shown as a liner 41*a* adhered to the inner surface of the base wall 40. Liner 41*a* may consist of a resilient layer and a thin layer of plastic or metal foil which contacts the finish. As shown in the modified form FIG. 12, the resilient sealing means may comprise a thin flexible annular flange 41*b* such as shown in U.S. Pat. No. 5,320,236, incorporated herein by reference.

Thread means is provided on the inner surface of the skirt 42 and may comprise single or multiple threads. Multiple threads 42 are preferred to provide easier removal and application of the closure. As shown, multiple threads 44 are equal in number to the number of threads on the finish 28 of the container 24. Closure 22 further includes a plurality of axial lugs 46, herein shown as four, one for each thread on the internal surface of the skirt 42 extending downwardly on the thinner portion 48 of the skirt 42 toward the free edge of the skirt 42.

Projections 32 on the finish extend radially outwardly a distance less than the threads 30. Abutments 34 extend radially outwardly a greater distance than the threads 30.

Figure 10:
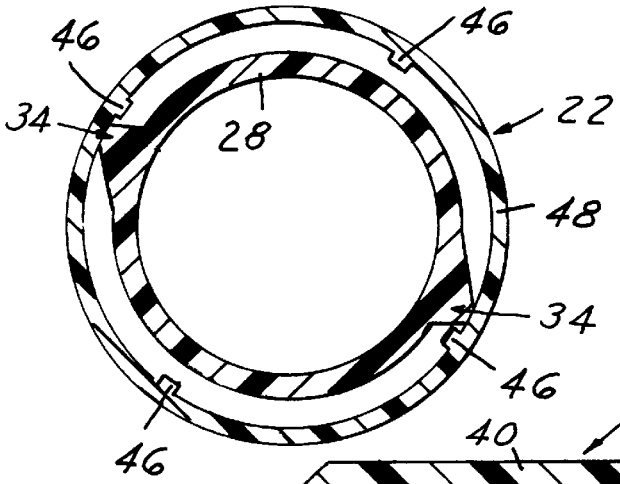
FIG. 10 is a sectional view taken along the line 10—10 in FIG. 1.

When the closure 22 is applied to the container 24 and rotated, the lugs 46 on the closure engage the inclined surfaces 36 on abutments 34 on the container 24 and when the closure 22 is fully applied, the lugs 46 pass the radial stop surfaces 38 on abutments 34, as shown in FIG. 10, producing an audible click. Axial projections 32 on the container 24 are positioned in line with the abutments 34. Therefore, when the lugs 46 on the interior of the closure are rotating past the abutments 34 of the finish, the closure is ovalized to some degree. This ovalization reduces or eliminates frictional contact between the closure threads 44 and the axial projections 32 that are in line with abutments 34. This requires that the amount of dimensional interference between the abutments 34 and the closure lugs 46, be greater than the dimensional interference between the closure threads 44 and the axial projections 32.

The present invention overcomes the deficiency with regard to disk type liners. That is, the design is such that it permits sealing of the package by having the top of the finish 28 contact the sealing means such as disk liner 41*a* or flange 41*b* over the range of closure and container finish tolerances. Degradation of removal torque, or backoff, is eliminated or reduced by using the axial projections 32 on the container finish 28 that interfere with the closure threads 44 when the closure 22 is fully applied regardless of the height tolerances. An additional feature of the present invention are the axial lugs 46 on the interior of the closure 22 that rotate past abutments 34 on the container finish, and emit an audible click. The audible click is produced by designing the abutments 34 such that they have a gentle incline on their leading surface 36 and an abrupt incline 38 on their trailing surface. Therefore, as the closure 22 is applied the lugs 46 on the closure will ride up on the leading surface, ovalizing the closure, and will tend to snap back to its original round shape when the closure lugs 46 encounter the abrupt trailing surface 38 on the abutment 34. It is intended that in the sealing of the package, the contact of the top of the finish 28 with the disk liner 41*a* or flange 41*b*, will occur simultaneously with the audible click, or within a few degrees of rotation. This would occur because of momentum. It is not likely that the closure 22 could be rotated past the abutment 34 and stopped before sealing could occur. Another event will also take place during the time each closure lug 46 is riding over the abutment 34 on container finish 28. As stated earlier, this causes the closure to ovalize, but the ovalization will in turn cause a reduction or elimination of the interference between the closure threads 44 and the axial projections 32 in line with the abutment 34. This condition may tend to somewhat reduce the build up of frictional drag that could give the consumer the impressions that the closure 22 was sufficiently applied prior to audible click occurring. Therefore, the alignment of the abutment 34 on the finish with the axial projections 32 is preferred.

It can thus be seen that there has been provided a consumer friendly package which permits the user to recognize that the closure has been applied fully to protect the contents; which provides a seal over a range of finish tolerances; which eliminates for inadvertent back-off of the closure; which provides an audible click upon application of the closure; wherein the closure is maintained centered to the containers finish; and which provides easy access to the contents.

What is claimed is:

1. A consumer friendly package comprising a plastic container including a body and a finish, a plastic closure including a base wall and a peripheral skirt, said container having a means for engagement on said finish, said closure having complementary means for engagement on the interior of the skirt, said container including at least one radial abutment on the finish, said container including at least one axial projection on the wall of the finish generally aligned with said abutment on said finish extending axially from said means for engagement on the container, said closure having said means for engagement engaging said axial projection on the finish, said closure including at least one lug thereon aligned with and engaging and passing over said radial abutments on the finish when the closure is threaded on the container to provide an audible click, resilient sealing means on said closure engaging said finish.

2. The package set forth in claim 1 wherein said container includes two radial abutments and said closure includes at least two lugs.

3. The package set forth in claim 2 wherein the container and closure means for engagement comprise four threads.

4. The package set forth in claim 3 including an axial projection extending from two of said threads on the container.

5. The package set forth in claim 1 wherein said abutment has a leading surface with a gentle incline and a tracking surface with an abrupt incline.

6. The package set forth in claim 1 wherein said axial projection on said closure is generally aligned with said abutment.

7. The package set forth in any one of claims 1–6 wherein said container and closure are constructed and arranged such that during the application of the closure to the container the closure will ovalize causing a reduction in interference between the means for engagement on the closure and axial projection on the finish.

8. The package set forth in claim 7 wherein said resilient sealing means comprises a liner.

9. The package set forth in claim 7 wherein said resilient sealing means comprises integral sealing means on said closure.

10. A method of making a consumer friendly package comprising providing a plastic container including a body and a finish having a means for engagement on said finish, a plastic closure including a base wall and a peripheral skirt having a means for engagement on the interior of the skirt, providing at least one radial abutment on the finish, providing at least one axial projection on the wall of the finish generally aligned with said abutment on said finish extending axially from said means for engagement on the container, providing said closure with said means for engagement thereon engaging said axial projection on said finish, providing said closure with at least one lug thereon aligned with and engaging and passing over said radial abutment on the finish when the closure is threaded on the container to provide an audible click, forming resilient sealing means on said closure for engaging said finish.

11. The method set forth in claim 10 including providing two radial abutments and providing at least two lugs on the closure.

12. The method set forth in claim 11 including providing four threads on the container and closure as said means for engagement.

13. The method set forth in claim 12 including providing an axial projection extending from two of said threads.

14. The method set forth in claim 10 including forming said abutment with a leading surface with a gentle incline and a tracking surface with an abrupt incline.

15. The method set forth in claim 10 including forming said axial projection on said closure such that it is generally aligned with said abutment.

16. The method set forth in any one of claims 10–15 including forming said container and closure such that during the application of the closure to the container the closure will ovalize causing a reduction in interference between the threads means on the closure and axial projection on the finish.

17. The method set forth in claim 16 wherein said step of providing said resilient sealing means comprises forming a liner.

18. The method set forth in claim 16 wherein said step of providing said resilient sealing means comprises integral sealing means on said closure.

* * * * *